US008002690B2

(12) United States Patent
Wiesmann et al.

(10) Patent No.: US 8,002,690 B2
(45) Date of Patent: Aug. 23, 2011

(54) CENTRIFUGE ROTOR HAVING A WASTE COLLECTING PART SEPARABLE FROM A BEARING PART

(75) Inventors: Karl Grosse Wiesmann, Nottuln (DE); Uwe Meinig, Bad Saulgau (DE)

(73) Assignee: Hengst GmbH & Co. KG, Muenster (DE)

( * ) Notice: Subject to any disclaimer, the term of this patent is extended or adjusted under 35 U.S.C. 154(b) by 963 days.

(21) Appl. No.: 11/913,485

(22) PCT Filed: Apr. 28, 2006

(86) PCT No.: PCT/EP2006/003962

§ 371 (c)(1),
(2), (4) Date: Nov. 2, 2007

(87) PCT Pub. No.: WO2006/117141

PCT Pub. Date: Nov. 9, 2006

(65) Prior Publication Data

US 2009/0272680 A1 Nov. 5, 2009

(51) Int. Cl.
*B04B 9/06* (2006.01)

(52) U.S. Cl. ..... 494/49; 494/83

(58) Field of Classification Search ..... 494/24, 494/36, 43, 49, 56, 64, 65, 67, 83, 84, 901, 494/60, 74, 79; 210/168, 171, 232, 360.1, 210/380.1, 416.5; 184/6.24

See application file for complete search history.

(56) References Cited

U.S. PATENT DOCUMENTS

| | | | | |
|---|---|---|---|---|
| 6,224,531 | B1 | 5/2001 | Frehland et al. | |
| 6,296,765 | B1 | 10/2001 | Brown et al. | |
| 7,396,325 | B2 * | 7/2008 | Meinig et al. | 494/49 |
| 7,713,185 | B2 * | 5/2010 | Baumann et al. | 494/49 |
| 2004/0157719 | A1 | 8/2004 | Amirkhanian et al. | |
| 2005/0187091 | A1 | 8/2005 | South | |
| 2008/0296212 | A1 * | 12/2008 | Baumann et al. | 210/167.08 |
| 2009/0272680 | A1 * | 11/2009 | Wiesmann et al. | 210/167.02 |

FOREIGN PATENT DOCUMENTS

| | | |
|---|---|---|
| DE | 484 609 | 10/1929 |
| DE | 19715661 | 10/1998 |
| DE | 10 2004 005920 | 8/2004 |
| DE | 102005008554 | 9/2005 |
| DE | 202004018743 | 4/2006 |
| WO | WO 2005087383 | 9/2005 |
| WO | 2007/006522 A1 * | 1/2007 |

* cited by examiner

*Primary Examiner* — Charles E Cooley

(74) *Attorney, Agent, or Firm* — Greer, Burns & Crain, Ltd.

(57) ABSTRACT

A rotor for a centrifuge (1), wherein the rotor is rotatably driven about a rotation axis and includes two parts, i.e., a central bearing part and a waste collecting part which is provided with a waste collecting area. The waste collecting part is separable from the bearing part for waste disposal or cleaning. The bearing part and waste collecting part are provided with torque transmitting surfaces which interact with each other in a form-fitting and/or adherence manner and are connectable by axially positioning the waste collecting part on the bearing part and disconnectable by axially removing the waste collecting part from the bearing part. The rotor is formed such that the circumferences of the bearing part and the waste collecting part are connectable in a form-fitting manner and arranged in such a way that the waste collecting part circumference is placed or rests on the corresponding circumference of the bearing part already at the initial state of the waste collecting part or as result of the radial expansion thereof produced by a centrifugal force and/or by heating.

25 Claims, 16 Drawing Sheets

CENTRIFUGE ROTOR HAVING A WASTE COLLECTING PART SEPARABLE FROM A BEARING PART

BACKGROUND OF THE INVENTION

This invention relates to a rotor for a centrifuge, wherein said rotor is rotatably driven about a rotation axis and consists of two parts, i.e. a central bearing part and a waste collecting part which is provided with a waste collecting area, the waste collecting part is separable from the bearing part for waste disposal or cleaning, the bearing part and the waste collecting part are provided with torque transmitting means which interact with each other in a form-fitting and/or adherence manner and are connectable by axially positioning the waste collecting part on the bearing part and disconnectable by axially removing the waste collecting part from the bearing part. The invention moreover relates to a centrifuge.

Centrifuges have been used for decades for a variety of applications and are thus known from practice in many different designs. A rotor with the above specified features is described in the Assignee's older, not prior published German utility model application no. 20 2004 004 215.0. In the rotor described therein, the bearing part comprises one recoil nozzle or a plurality of recoil nozzles for driving the rotor by means of lubricating oil exiting via the nozzle or the nozzles so that the bearing part here forms a drive part of the rotor.

With all centrifuges known and used so far, an inside diameter of the rotor is generally centered on an outside diameter of the axis or an outside diameter of a component located between axis and rotor, such as rotor bearing or drive part. To be able to assemble and disassemble a two-part rotor consisting of a bearing part and a waste collecting part, an assembly clearance between the parts of the rotor is required as a rule; at maximum, slight pressing is permissible so that the rotor can still be assembled and disassembled. To save weight and manufacturing costs, it is increasingly aimed at building the rotor as light-weight as possible, for example by using plastic instead of metal. During operation of the centrifuge, a waste collecting part of plastic is subject in particular to the risk of deformation under the effect of centrifugal forces and/or heat. In the rotors known so far, this results in the inside diameter of the waste collecting part becoming larger. Thus, in centrifuge operation, an increasing clearance results in the area of the connection between waste collecting part and bearing part, resulting in an increasing imbalance and thus performance losses of the centrifuge, a reduced bearing life, and in offending noises.

Accordingly, it is the objective of this invention to provide a rotor and a centrifuge of the type indicated in the beginning which avoid the disadvantages indicated and, in particular, the occurrence of imbalances in operation, thus ensuring high performance with a good endurance limit and a low operating noise level.

SUMMARY OF THE INVENTION

In accordance with the invention, this objective is solved by a rotor of the type indicated in the beginning which is characterized in that the circumferences of the bearing part and the waste collecting part are connectable in a form-fitting manner and arranged in such a way that the waste collecting part circumference is placed or rests on the corresponding circumference of the bearing part already at the initial state of the waste collecting part or as a result of the radial expansion thereof produced by a centrifugal force and/or by heating.

In the rotor according to the invention, it is achieved that the bearing part which can be unproblematically designed to be dimensionally stable will ensure exact centering and thus balanced true running of the waste collecting part which is a hollow body and made of plastic and thus is more instable per se. The centrifugal force resulting with the rotation of the rotor during the operation of the centrifuge even ensures that the circumference of the waste collecting part rests on the corresponding circumference of the bearing part which is stable in form and position so that, through the rotation of the rotor, the waste collecting part inevitably assumes an exactly dynamically balanced form and maintains it during the rotation of the rotor. The waste collecting part of plastic can thus be produced relatively easily and with relatively minor material thicknesses without the risk of performance-reducing imbalances which is advantageous not only for the manufacture but also for the operation of the centrifuge. The waste collecting part circumference's resting on the circumference of the bearing part under the effect of the centrifugal force during the operation of the centrifuge moreover advantageously reduces, through the flow of force generated thereby, the micro-movements between the bearing part and the waste collecting part. This counteracts any material removal and wear in this area through the effect of e.g. vibration accelerations introduced from the outside.

A first embodiment furthermore provides that the form-fitting circumference is formed by annular areas. This will particularly effectively ensure an exactly round form of the waste collecting part upon the rotation of the rotor.

It is furthermore proposed that the bearing part is made of metal or plastic and comprises axially on top and/or axially on the bottom one annular area (each) concentric to the rotation axis, that the waste collecting part is made of plastic and comprises axially on top and/or axially on the bottom one annular area, and that—in a combined condition of bearing part and waste collecting part—the annular area of the bearing part encompasses (in each case) the annular area of the waste collecting part radially outside.

Another embodiment provides according to the invention that the annular area of the bearing part is designed, seen in its circumferential direction, extending continuously or as a sequence of two or more annular sections. The annular area fulfills its function of centering the waste collecting part in each of the two above-mentioned embodiments. Depending on the way of manufacturing the bearing part, one or the other embodiment may be more advantageous in terms of manufacturing.

Analogously, the annular area of the waste collecting part, seen in its circumferential direction, can be designed extending continuously or as a sequence of two or more annular sections.

It is provided in one embodiment of the rotor that the/each annular area of the waste collecting part comprises, upon the standstill of the rotor, an initial dimension d of its outer diameter which is smaller than the inner diameter D or equal to the inner diameter D of the annular area of the bearing part, and that upon the rotation of the rotor during operation of the centrifuge the/each annular area of the waste collecting part in its outer diameter is expandable by the effect of the centrifugal force on the diameter D. In this embodiment, it is particularly simple to assemble and disassemble the rotor since, first of all, there is an assembly clearance according to the dimensional difference between the inner diameter D and the initial dimension d of the outer diameter or at least no excess of the outer diameter d relative to the inner diameter D. During the centrifuge operation, the rotation of the rotor and the centrifugal force thus generated will inevitably take care that the outer diameter of the waste collecting part increases from its initial dimension d to the inner diameter D of the annular area of the bearing part whereby it is then ensured that the two annular areas of waste collecting part and bearing part circumferentially rest on each other. Mutual resting provides for a dynamically balanced form of the waste collecting part and for good true running without imbalances. During the standstill of the rotor, the outer diameter of the annular area of the waste collecting part can be reduced again to its initial dimension d, thereby then also enabling easy disassembly of the waste collecting part from the bearing part.

As an alternative to the above described embodiment, it is possible that the/each annular area of the waste collecting part comprises, upon the standstill of the rotor, an initial dimension d of its outer diameter which is larger than the inner diameter D of the annular area of the bearing part, and that after axial positioning of the waste collecting part on the bearing part their annular areas are in connection with each other under pretension. The diameter difference d-D is here, of course, limited to such values in which it is still possible to connect and separate the bearing part and the waste collecting part without any problem.

It is furthermore provided that the bearing part on top has a tubular, upwardly open end section as the annular area and that the waste collecting part on top has a central, axially inwardly extending collar engaging in the end section as the annular area. In this embodiment, the collar projects into the tubular end section; thus, the two interacting annular areas in the upper part of the rotor are very simple, yet effective in design so that the manufacture of the rotor does not entail any major additional manufacturing and machining expenditure for the realization of the annular areas.

To secure the waste collecting part on the bearing part during centrifuge operation and to prevent these two parts from making any undesirable relative movement, it is furthermore provided that the end section forming the annular area and the collar forming the annular area are equipped with interacting latching means forming a disengageable latching connection for the removal of the waste collecting part. The latching connection is preferably manually disengageable to be able to do so without any operating tools during maintenance for the purpose of simple handling and fast removal and installation of the waste collecting part.

In another embodiment of the above mentioned latching connection, the collar forming the annular area preferably comprises two operating arms protruding upwardly over the waste collecting part for manual disengagement of the latching connection. These operating arms enable a simple separation of the waste collecting part from the bearing part without auxiliary tools which is advantageous for fast, time-saving maintenance of the centrifuge.

A modified embodiment provides that the bearing part on top comprises an annular, downwardly open crest as an annular area and that the waste collecting part on top comprises a central, axially outwardly extending collar engaging into the crest as an annular area. In this embodiment, the crest can advantageously be used to simultaneously secure the rotor on the axis against undesirable axial movements.

The form-fitting circumferences provided on the bearing part and on the waste collecting part can be formed, instead of by annular areas, alternatively by axial projections on the one hand and corresponding recesses on the other hand. In this case, the projections and recesses may be provided concentrically or even eccentrically to the rotation axis of the rotor since this is without importance here for the function of the circumference. The axial projections may be allocated to the bearing part or to the waste collecting part; it is also possible to allocate the axial projections partly to the bearing part and partly to the waste collecting part. The corresponding openings are then provided in the correspondingly other part each. Thus, this embodiment has a particular freedom of design with regard to the position of the projections and recesses which may be advantageous for some rotor models.

A shape which is technically simple to manufacture and thus economical will result when the axial projections are formed by pins and the corresponding recesses by borings.

It is furthermore preferably provided that the form-fitting circumference, seen in radial direction, is arranged in the inner half, preferably in the inner third, of the radius of bearing part and waste collecting part. Due to this radially relatively far inwardly provided arrangement of the form-fitting circumferences, they are much less stressed by centrifugal forces during the rotation of the rotor which here permits relatively small material thicknesses and thus saves weight.

Another embodiment of the rotor according to the invention provides that the waste collecting part comprises driving means for driving the rotor.

A further development in this respect proposes that the bearing part comprises a central tubular body with two radially outwardly extending openings and that the waste collecting part comprises two sealing oil channels connected with the openings and each leading to a recoil nozzle. In this embodiment of the rotor, the recoil nozzles are part of the waste collecting part so that new recoil nozzles are also installed in the rotor upon any replacement of the waste collecting part within the scope of maintenance of the centrifuge—which is advantageous for reliable functioning.

It is alternatively proposed that the bearing part comprises driving means for driving the rotor. In this embodiment, the bearing part is thus simultaneously the driving part of the rotor.

A preferred further development in this respect provides that the bearing part comprises one central tubular body forming a lubricating oil channel and two nozzle arms extending radially outwardly from the tubular body with one oil channel each leading to respectively one recoil nozzle, and that the form-fitting circumference of the bearing part is formed or provided at least partly on the nozzle arms. In this embodiment of the rotor, the waste collecting part which is replaced during maintenance of the centrifuge can be manufactured in a particularly simple manner and thus also particularly economically because it does not comprise any driving means. The bearing part here simultaneously forming the drive part can be designed as a high-quality lifetime component and can remain permanently in the centrifuge. At the same time, the form-fitting circumference of the bearing part can here be integrated in a favorable manner in terms of space as well as production engineering.

Another embodiment provides that the form-fitting circumference of the bearing part additionally rests on carrying arms extending radially outwardly from the tubular body. These carrying arms are provided in particular between the nozzle arms to achieve—in the circumferential direction of the bearing part, at uniform spaces and in several places—a fixation of the form-fitting circumference, e.g. the annular area on the bearing part side, and to thus ensure its exact shape and position even over long operating periods of the rotor.

It is furthermore provided that the waste collecting part is designed on the bottom as one piece with a central collar extending axially outwardly as an annular area. This collar provided on the bottom of the waste collecting part can also be simply manufactured so that no appreciable additional manufacturing expenditure is here incurred either. Furthermore, this axially outwardly extending collar in the lower part of the waste collecting part is connectable and disconnectable with an associated annular area of the bearing part by means of a simple axial movement of the waste collecting part relative to the bearing part.

To be able to manufacture the waste collecting part as inexpensively as possible in large quantities, the invention furthermore proposes that the waste collecting part is comprised of two one-piece injection molded parts each which are tightly connected with each other in a plane perpendicular to the rotation axis of the rotor.

It is preferably furthermore provided that the two injection molded parts of the waste collecting part are welded with each other. This welding is particularly favorable if the plastic which the two injection molded parts of the waste collecting part are made of is a thermoplastic. For example, the plastic polyamide (PA) is suitable for it.

Another measure for realizing an inexpensive production is that the tubular body with the nozzle arms and the annular carrying arms is preferably a one-piece die cast part or injection molded part. A light metal in particular, such as aluminum or magnesium, is to be advantageously used as the material. Alternatively, the material to be used for it can also be correspondingly strong and durable plastics, e.g. polyphenylene sulfides (PPS) or thermosetting plastics.

The subject matter of this invention is furthermore a centrifuge which is characterized by comprising a rotor according to any one of the preceding claims. Such a centrifuge is particularly economical, reliable and quiet in operation.

These advantages come to bear particularly well when the centrifuge is a centrifuge for cleaning the lubricating oil of an internal combustion engine, e.g. of a motor vehicle.

BRIEF DESCRIPTION OF THE DRAWINGS

Exemplary embodiments of the centrifuge according to the invention are explained in the following with reference to a drawing. In the Figures.

DETAILED DESCRIPTION OF THE PREFERRED EMBODIMENT

Figure 1:
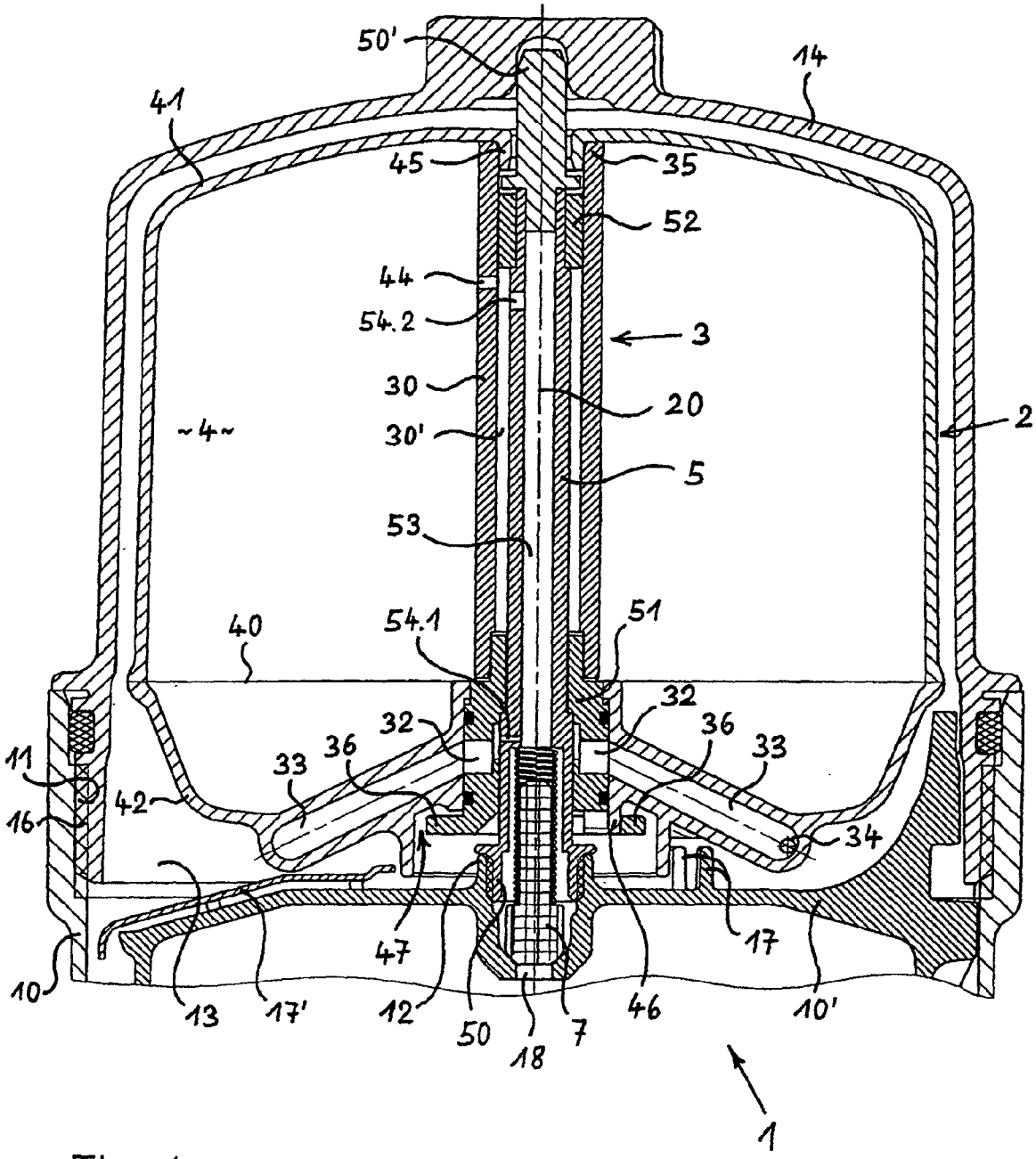
FIG. 1 shows a centrifuge with a rotor in a first embodiment in a longitudinal section.

The centrifuge 1 according to FIG. 1 comprises a housing 10 whose upper part is formed by a screw cover 14. For this, the housing 10 has an internal thread 11 into which an external thread 16 of the cover 14 engages. A housing part 10' is here inserted into the housing 10 which comprises in its center an axis receiver 12 with an internal thread. One axis 5 is screwed into the axis receiver 12 by means of one lower threaded end 50. The axis extends upwardly and is held centrically on the inside in cover 14 by means of an upper, separately pressed-in axis end 50'.

On the axis 5, a rotor 2 is rotatably provided on bearings by the intermediate layer of one upper and lower friction bearing each 51, 52.

The rotor 2 comprises a central bearing part 3 and a disengageable waste collecting part 4 connected with the bearing part 3. With opened cover 14, the waste collecting part 4 can be removed upwardly in axial direction from the bearing part 3 and replaced by a new waste collecting part 4. Full waste collecting parts 4 can thus be regularly and easily replaced.

The bearing part 3 is a lifetime component of the centrifuge 1 and remains permanently on the axis 5. The bearing part is here of metal for stability reasons.

The waste collecting part 4 is here of plastic especially for weight reasons and for realizing low manufacturing costs, as well as for the purpose of simple disposal. Furthermore, the waste collecting part 4 here comprises a top part 41 and a bottom part 42 which are tightly welded to each other along a weld seam 40 running in circumferential direction. In the exemplary embodiment according to FIG. 1, the bottom part 42 of the waste collecting part 4 also comprises the drive means for the rotor 2 which are here formed by two oil channels 33 integrated into the bottom part 42, with one recoil nozzle 34 each on their radially exterior end.

The bearing part 3 is comprised of a tubular body 30 to an axially major part. At its axially upper end, the tubular body 30 of bearing part 3 forms an upper annular area 35, into which an upper annular area 45 of the waste collecting part 4 engages. The annular area 45 of the waste collecting part 4 is here formed by an axially downwardly extending collar whose outer diameter is equivalent to or slightly smaller than the inner diameter of the annular area 35 of the bearing part 3.

By means known per se but not separately shown in the drawing, the rotor 2 is secured on axis 5 against any undue displacement in axial direction towards the top.

At its bottom end area, the bearing part 3 is designed with a bottom annular area 36 into which a second, axially downwardly extending annular area 46 of the waste collecting part 4 engages radially inside. Upon rotation of the rotor 2 in the operation of the centrifuge 1, the upper annular area 45 and the lower annular area 46 of the waste collecting part 4 rest in radial positioning on the upper annular area 35 and the lower annular area 36 of the bearing part 3 as a result of the centrifugal force. Since this bearing part 3 is made of a dimensionally stable metal, an exactly centered alignment of the waste collecting part 4 relative to the bearing part 3 thus results and thus also relative to the rotation axis 20 of the rotor 2 which results in good true running of the rotor even if its waste collecting part 4 consists of a less dimensionally stable material, especially plastic.

A minimum pressure valve 7 known per se is provided with the centrifuge 1 according to FIG. 1 so that lubricating oil flowing through the rotor 2 will only be released when the lubricating oil pressure has reached a certain minimum value. This minimum pressure valve 7 is provided in the lower part of the axis 5 and opens or closes an inlet 18 according to the respectively applicable lubricating oil pressure which is centrally provided in the housing part 10' below the bottom axis end 50 of the hollow axis 5.

When the lubricating oil pressure is sufficiently high and the minimum pressure valve 7 is opened, the lubricating oil flows through the inlet 18 into a central channel 53 which penetrates the axis 5 in its longitudinal direction. The lubricating oil flow is then divided into two partial lubricating oil flows. A first partial flow flows through at least one first radial channel 54.1 from the area directly above the minimum pressure valve 7 in radial direction towards the outside and further through two radial openings 32 through the bearing part 3 radially from the inside to the outside to finally reach two oil channels 33 which are congruently aligned with the radial openings 32 and lead to the recoil nozzles 34.

A second partial lubricating oil flow flows through the central channel 53 in the axis 5 further to the top and, close to the upper end of the axis 5, it passes into a ring channel 30' through a second radial channel 54.2. This ring channel 30' is limited radially inside by the outer circumference of the axis 5 and radially outside by the inner circumference of the tubular body 30 of the bearing part 3. Directly underneath the upper friction bearing 52, at least one oil inlet 44 which extends in radial direction and is here designed as a boring will pass from the annular gap 30' into the interior of the waste collecting part 4. The lubricating oil to be cleaned then flows through the waste collecting part 4 from top to bottom seen in axial direction; in the bottom part 42 of the waste collecting part 4, an oil drain 47 is provided radially inside which is not completely visible here through which the cleaned lubricating oil passes into a pressureless oil drain area 13 of the housing 10.

As known per se, the upper friction bearing 52 is supplied with lubricating oil through at least one channel which is not separately shown here.

To prevent any reciprocal interference between the oil jets exiting from the recoil nozzles 34 and the partial oil flow exiting from the outlet 47, either deflecting ribs 17 are provided on the top side of the housing part 10' as shown in the right half of FIG. 1, or a shielding disk 17' is provided extending parallel to the top side of the housing part 10' as shown in the left half of FIG. 1.

Figure 2:
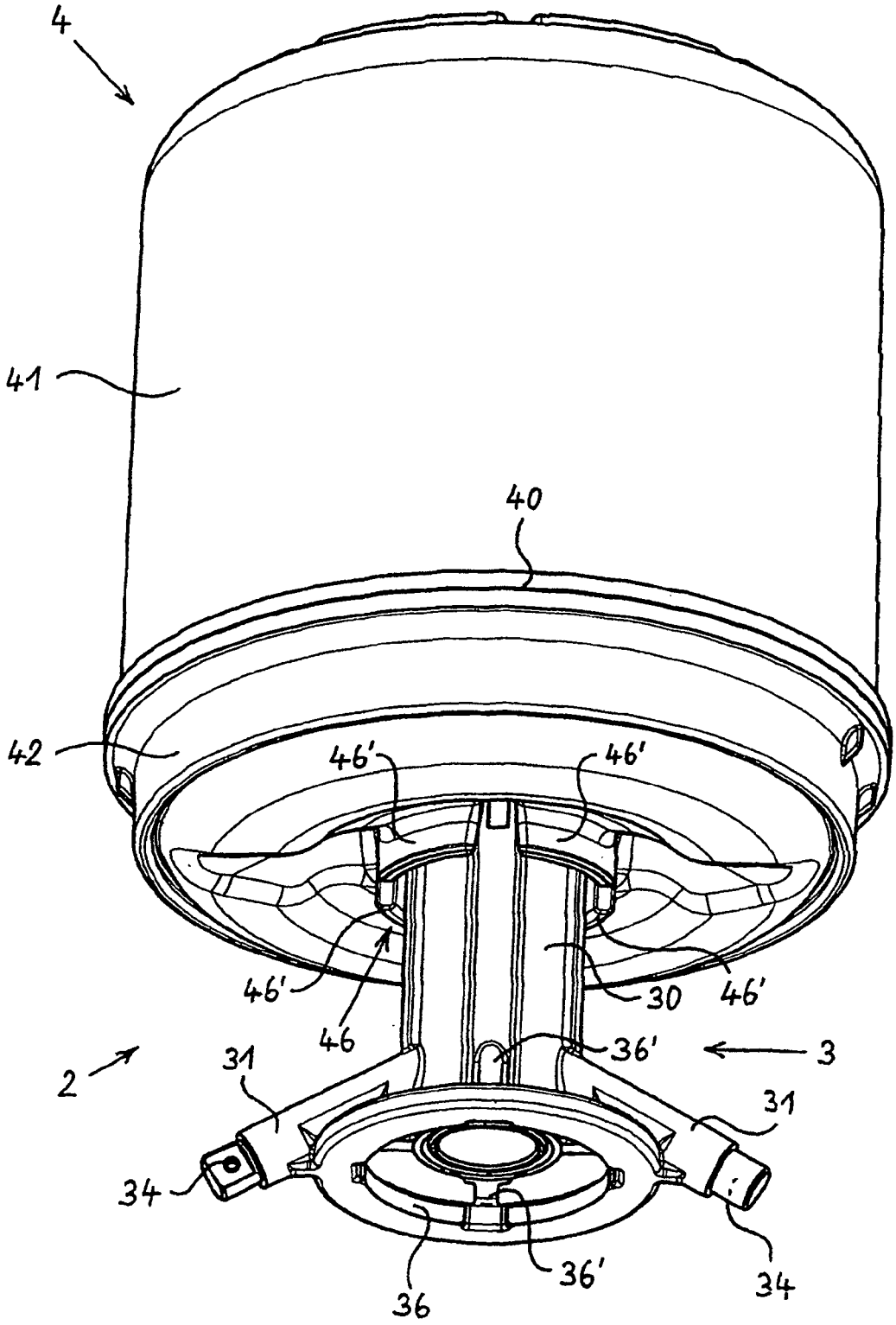
FIG. 2 shows the rotor in a modified embodiment in a perspective, partly exploded view of the bearing part and the waste collecting part of the rotor.

FIG. 2 shows a rotor 2 of a centrifuge in an embodiment modified versus FIG. 1, with the bearing part 3 and the waste collecting part 4 shown during their assembly or separation in FIG. 2 in only partly assembled condition, in a perspective view.

The lower part of FIG. 2 shows the lower section of the bearing part 3. The upper, central area of the bearing part 3 is formed by the tubular body 30 which is here located in parts in the waste collecting part 4. Close to its bottom end, two nozzle arms 31 extend from the tubular body 30 in two diametrically opposed radial directions, the arms each being equipped at their end with a separately mounted recoil nozzle 34.

The lower annular area 36 of the bearing part 3 is held on the two nozzle arms 31 as well as the two carrying arms 36 provided between the nozzle arms 31. The annular area 36 here has the shape of a circular ring disk with a circumferential inner circumference surface radially extending inwardly.

The upper part of FIG. 2 shows the waste collecting part 4 of the rotor 2 which is connected with the bearing part 3 by axial positioning, with a displacement direction from top to bottom relative to the bearing part 3. Upon movement of the waste collecting part 4 in axial direction downwardly, the lower annular area 46 of the waste collecting part 4 is connected with the lower annular area 36 of the bearing part 3. At the same time, the nozzle arms 31 pass into two form-fitting cavities on the underside of the waste collecting part 4 whereby the two parts 3 and 4 are held torsionally resistant to each other.

In assembled condition, the annular area 46—which is here formed of a total of four sections 46' following each other at a small distance—rests on the inner circumference surface of the annular area 36 of the bearing part 6 and is precisely centered in its position by it. This centering is even improved upon rotation of the rotor 2 during operation of the centrifuge 1 because the resulting centrifugal forces ensure an exact placement of the outer circumference surface of the annular area 46 of the waste collecting part 4 on the inner circumference surface of the annular area 36 of the bearing part 3.

Finally, FIG. 2 also shows that the waste collecting part 4 is comprised of the top part 41 and the bottom part 42 which are tightly and permanently connected with each other along the weld seam 40.

Figure 3:
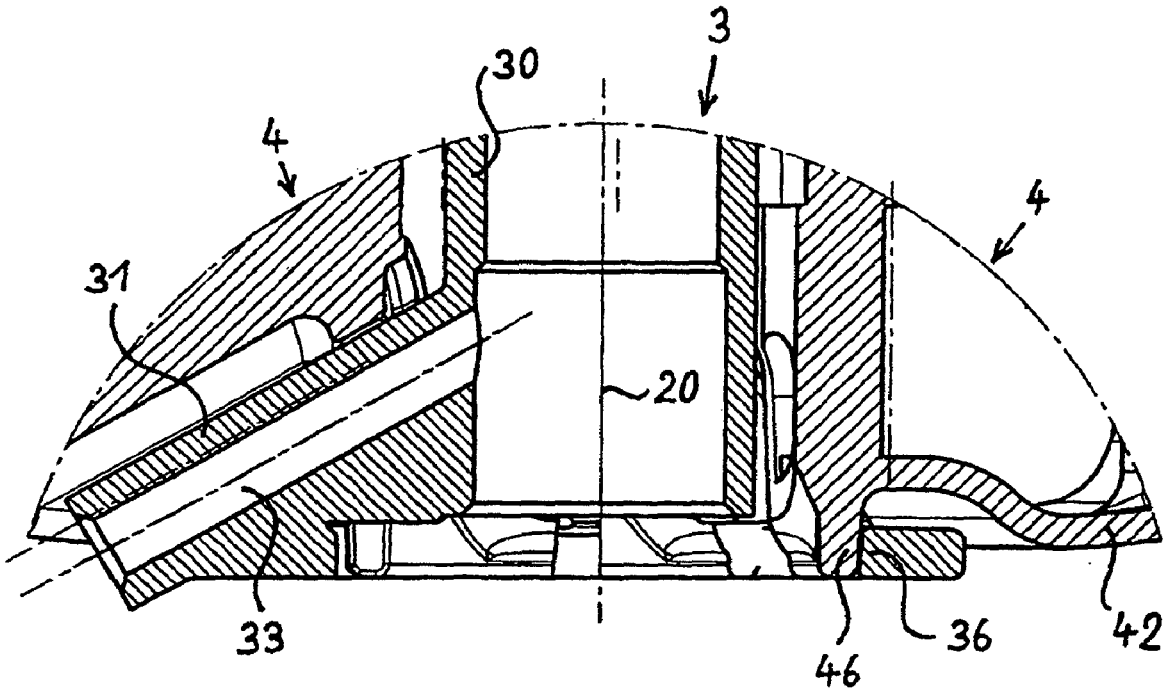
FIG. 3 shows the lower part of the rotor of FIG. 2 in assembled condition in a longitudinal section.

In an enlarged detail, FIG. 3 shows the lower area of rotor 2 of FIG. 2 in its final assembled condition in longitudinal section. The bearing part 3 is located in the center, of which only the lower area of the tubular body 30 is visible here. On the left in FIG. 3, one of the nozzle arms 31 is visible with the oil channel 33 running through it. In the right half of FIG. 2, the sectional cut does not run through the second nozzle arm because the sectional direction is here twisted in circumferential direction about the rotation axis 20 of the rotor 2 (cf. FIG. 1).

A small part of the bottom part 32 of the waste collecting part 4 is visible radially outside of the tubular body 30. On the bottom right in FIG. 3, the lower annular area 46 of the waste collecting part 4 is visible radially inside; the lower annular area 36 of the bearing part 3 is provided radially directly outside from it. It is here clearly visible that the outer circumference surface of the annular area 46 of the waste collecting part 4 rests on the inner circumference surface of the annular area 36 of the bearing part 3.

FIG. 3 moreover illustrates that the nozzle arms 31 are provided, over a part of their length, in the bottom part 42 of the waste collecting part 4; thus a twist-proof positioning of waste collecting part 4 and bearing part 3 relative to each other is realized in a simple way in completely assembled condition. Thus, no undesirable relative movements of bearing part 3 and waste collecting part 4 can occur relative to each other in circumferential direction.

Figure 4:
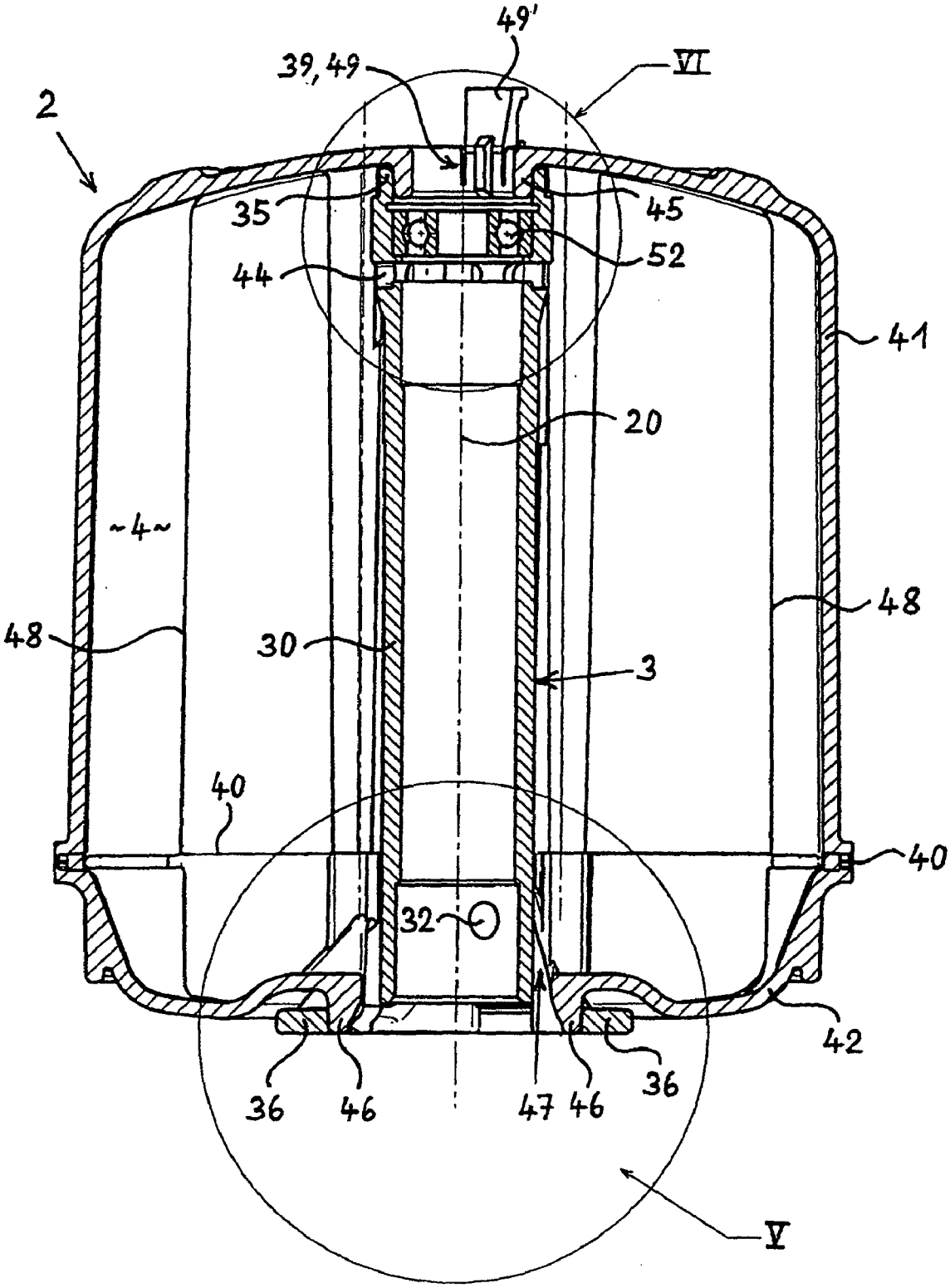
FIG. 4 shows the rotor of FIG. 2 in assembled condition in a longitudinal section.

FIG. 4 shows another rotor 2 in a longitudinal section. Here again the rotor 2 is comprised of the central bearing part 3 and the waste collecting part 4 connected with it.

Here again, the bearing part 3 has a central tubular body 30 whose upper end is designed as the upper annular area 35 and the lower annular area 36 is provided at its lower end area.

Here again, the waste collecting part 4 is comprised of two parts, i.e. the pot-shaped top part 41 and the bottom part 42 which are connected with each other along the weld seam 40. As the upper annular area 45 of the waste collecting part 4, an axially inwardly projecting collar is integrally molded in the center of the top part 41, the collar engaging radially inside in the upper annular area 35 of the bearing part 3. In this area, a rolling bearing is furthermore provided as the upper bearing 52 on the inside of the tubular body 30 in this embodiment of the rotor 2. The oil inlet 44 is provided directly underneath the bearing 52 and is used for the introduction of the lubricating oil to be cleaned into the interior of the waste collecting part 4.

An axially downwardly projecting collar is integrally molded in one-piece on the bottom part 42 of the waste collecting part 4 as the lower annular area 46. In assembled condition as shown in FIG. 4, the lower annular area 46 of the bottom part 42 rests radially inside on the inner circumference of the lower annular area 36 of the bearing part 3. In this way, the waste collecting part 4 is exactly centered on top and bottom relative to the bearing part 3. Since the inherently dimensionally highly stable bearing part 3 is exactly centered in bearing position relative to the rotation axis 20, the waste collecting part 4 is also exactly centered to the rotation axis 20 of the rotor 2.

Figure 5:
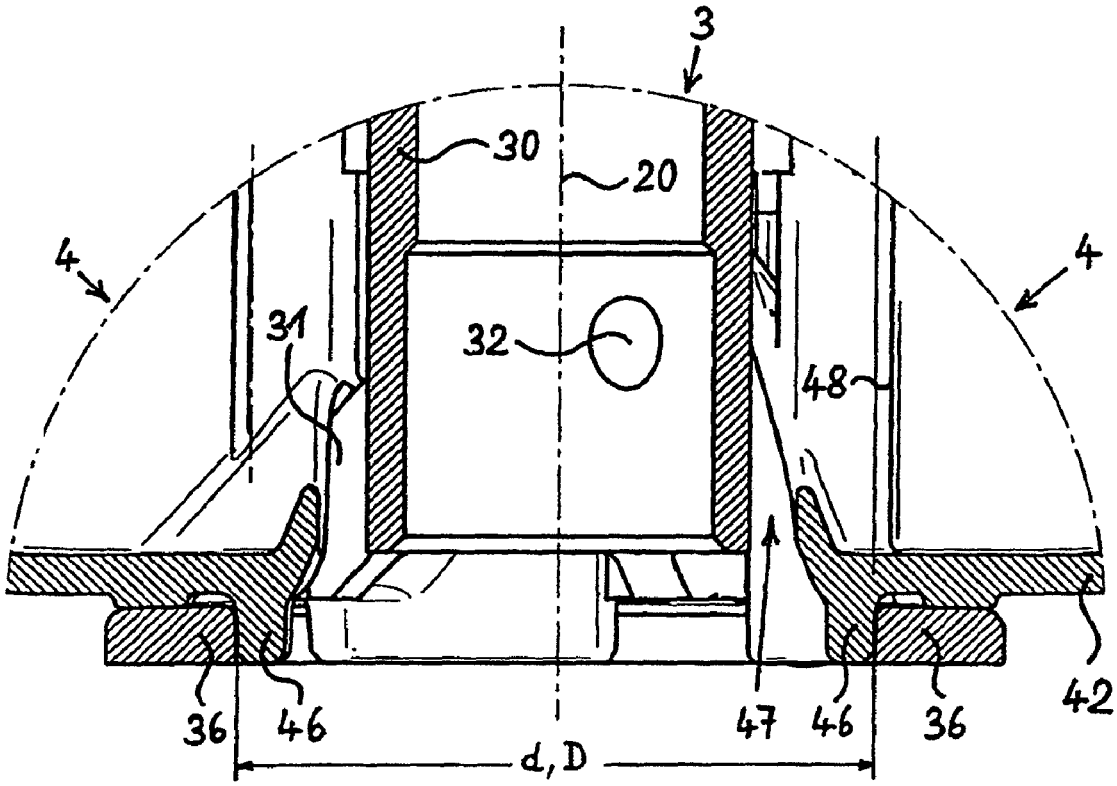
FIG. 5 shows the area V circled on the bottom in FIG. 4, in an enlarged view.

In an enlarged view, FIG. 5 shows the lower area V circled in FIG. 4. The lower part of the bearing part 3 with the tubular body 30 is visible in the center of FIG. 5. Moreover, one of the radial openings 32 is visible here which leads into one of the two oil channels 33 running through the nozzle arms 31. On the bottom and radially outside in FIG. 5, the annular area 36 of the bearing part 3 is visible in a sectional view.

Radially outside of the bearing part 3, the lower part of the waste collecting part 4 is located which is provided radially inside with the axially downwardly projecting lower annular area 46 as a one-piece collar integrally molded to the bottom part 42. Here again, it is clearly shown that, in the assembled condition of the rotor 2, the outer circumference of the lower annular area 46 of the waste collecting part 4 rests on the inner circumference of the dimensionally stable lower annular area 36 of the bearing part 3 by means of which the waste collecting part 4 is centered relative to the bearing part 3 and relative to the rotation axis 20.

The annular area 36 here has an inner diameter D which is adapted to the outer diameter d of the annular area 46. In its basic condition, upon standstill of the rotor 2, the outer diameter d of the annular area 46 can also have a dimension which is smaller by an assembly clearance than the inner diameter D; the centrifugal force upon rotation of the rotor 2 then provides for an expansion of the outer diameter d to the inner diameter D.

FIG. 5 moreover shows the course of the outlet 47 through which the lubricating oil passes from the interior of the waste collecting part 4 into the pressureless area of the interior of the housing of the centrifuge.

Figure 6:
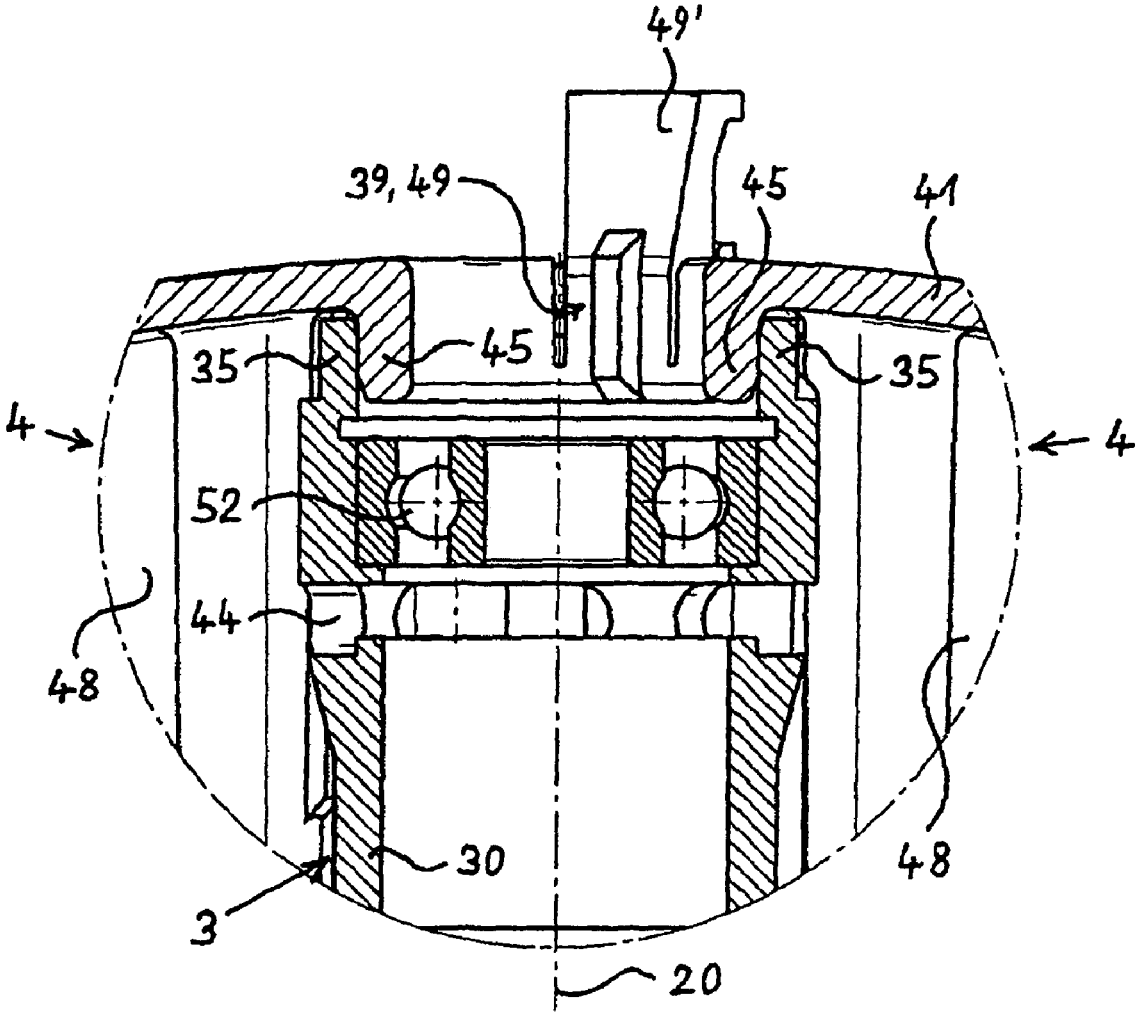
FIG. 6 shows the area VI circled on the top in FIG. 4, in an enlarged view.

In an enlarged view, FIG. 6 shows the upper area VI circled in FIG. 4. Here again, the bearing part 3 is located in the center of FIG. 6, now with the upper area of its tubular body 30. The upper end of this tubular body 30 forms the upper annular area 35 of the bearing part 3.

The upper annular area 45 of the top part 41 of the waste collecting part 4 interacts with the annular area 35, and here again, the outer circumference of the annular area 45 rests on the inner circumference of the annular area 35. In terms of its accuracy, the resting effect is even positively influenced upon rotation of the rotor 2 (cf. FIG. 4) due to the resulting centrifugal force acting upon the waste collecting part 4.

The upper bearing 52 is provided in the form of a rolling bearing underneath the two annular areas 35 and 45. Inlet 44 is located under the rolling bearing 52, and the lubricating oil to be cleaned passes through it into the interior of the waste collecting part 4. Radially extending deflecting walls 48 regularly spaced from each other in circumferential direction are provided in the interior of the waste collecting part 4, the walls ending radially inside spaced apart from the tubular body 30 of the bearing part 3.

Finally, latching means 39, 49 are also visible at the very top in the center of FIG. 6 which are used to connect in a latching manner the waste collecting part 4 with the bearing part 3—yet manually easily disengageable. For loosening the latching connection, operating arms 49' are here used which project upwardly over the top side of the upper part 41 of the waste collecting part 4, with only one of these operating arms 49' being visible in the section in FIG. 6.

Figure 7:
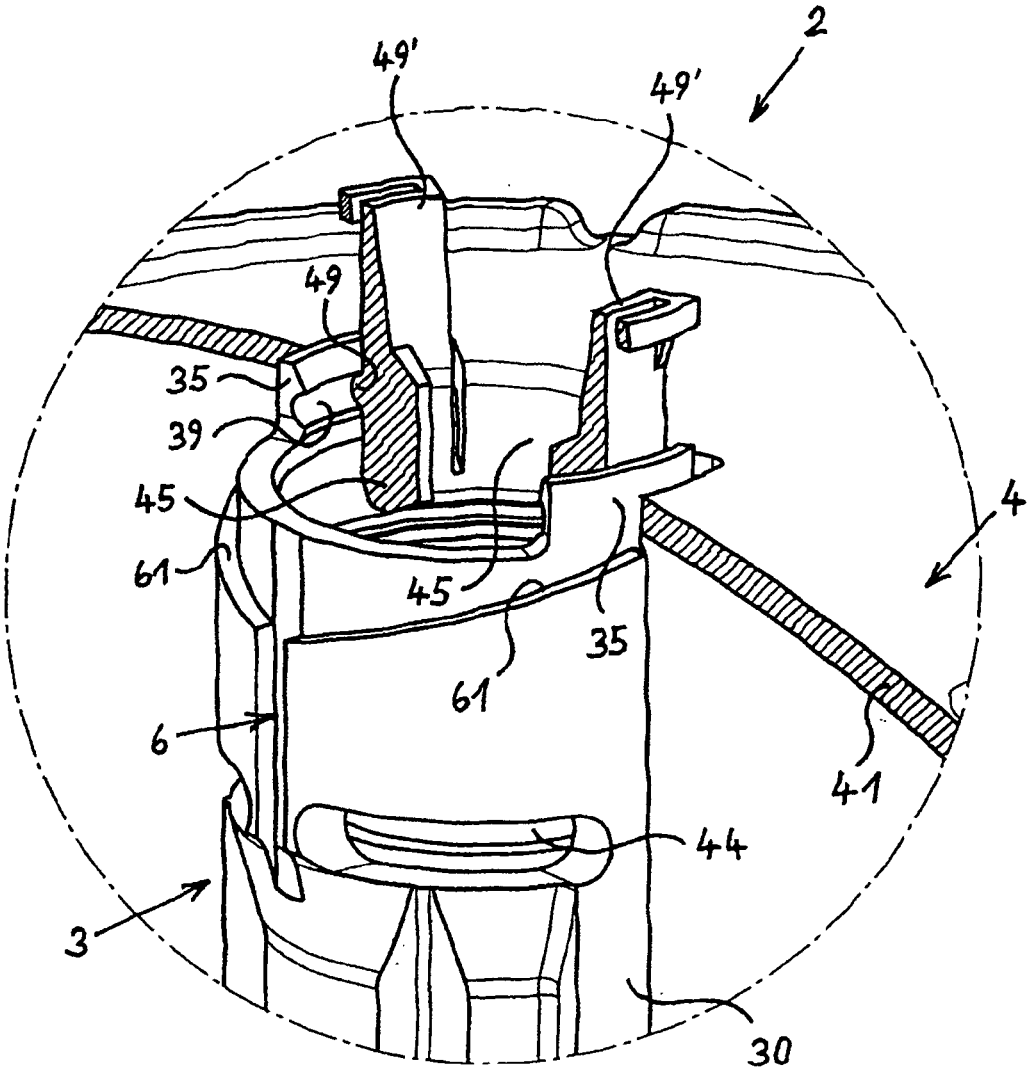
FIG. 7 shows the upper area of the rotor of FIG. 4 in a perspective, partly sectional view.

Finally, FIG. 7 shows the upper area of the rotor 2 according to FIG. 4 in a perspective, partly sectional view. In the lower part of FIG. 7, the upper area of the bearing part 3 is visible—here its tubular body 30 with the inlet 44 for the passage of the lubricating oil into the interior of the waste collecting part 4.

In the upper right-hand area of FIG. 7, one part of the top part 41 of the waste collecting part 4 is visible, the top part 41 here being cut in a section to render the bearing part 3 visible which is located in the interior of the waste collecting part 4.

The upper end of the tubular body 30 is designed with the upper annular area 35 into which engages the upper annular area 45 of the waste collecting part 4. The latching means already mentioned before are here concretely formed by a latching groove 39 integrally molded in the inner circumference of the annular area 35 and by a latching bead 49 matching the latching groove 39 on the outer circumference of the annular area 45 of the waste collecting part 4.

The two operating arms 49' project upwardly through the top part 41 of the waste collecting part 4. When they are pressed by an operating person in radial direction inwardly onto each other, the latching bead 49 extends from the associated latching groove 39, and the waste collecting part 4 can be smoothly removed in axial direction upwardly from the bearing part 3 to replace a spent waste collecting part 4 filled with waste particles by a fresh waste collecting part 4 within the scope of maintenance of the centrifuge.

Furthermore, with the bearing part 3 shown in FIG. 7, positioning means 6 are provided on it which here have the form of two deepened grooves extending in axial direction on the outer circumference of the tubular body 30. Above the diametrically opposed positioning means 6, two converging inlet bevels 61 are integrally molded which are used to properly position the waste collecting part 4 and the bearing part 3 towards each other upon their assembly in their circumferential direction to then push them in axial direction into the final installation position. In this final installation position, the latching means 39, 49 engage, and the waste collecting part 4 is then secured in this position on the bearing part 3 not only in axial direction but also in circumferential direction.

Figure 8:
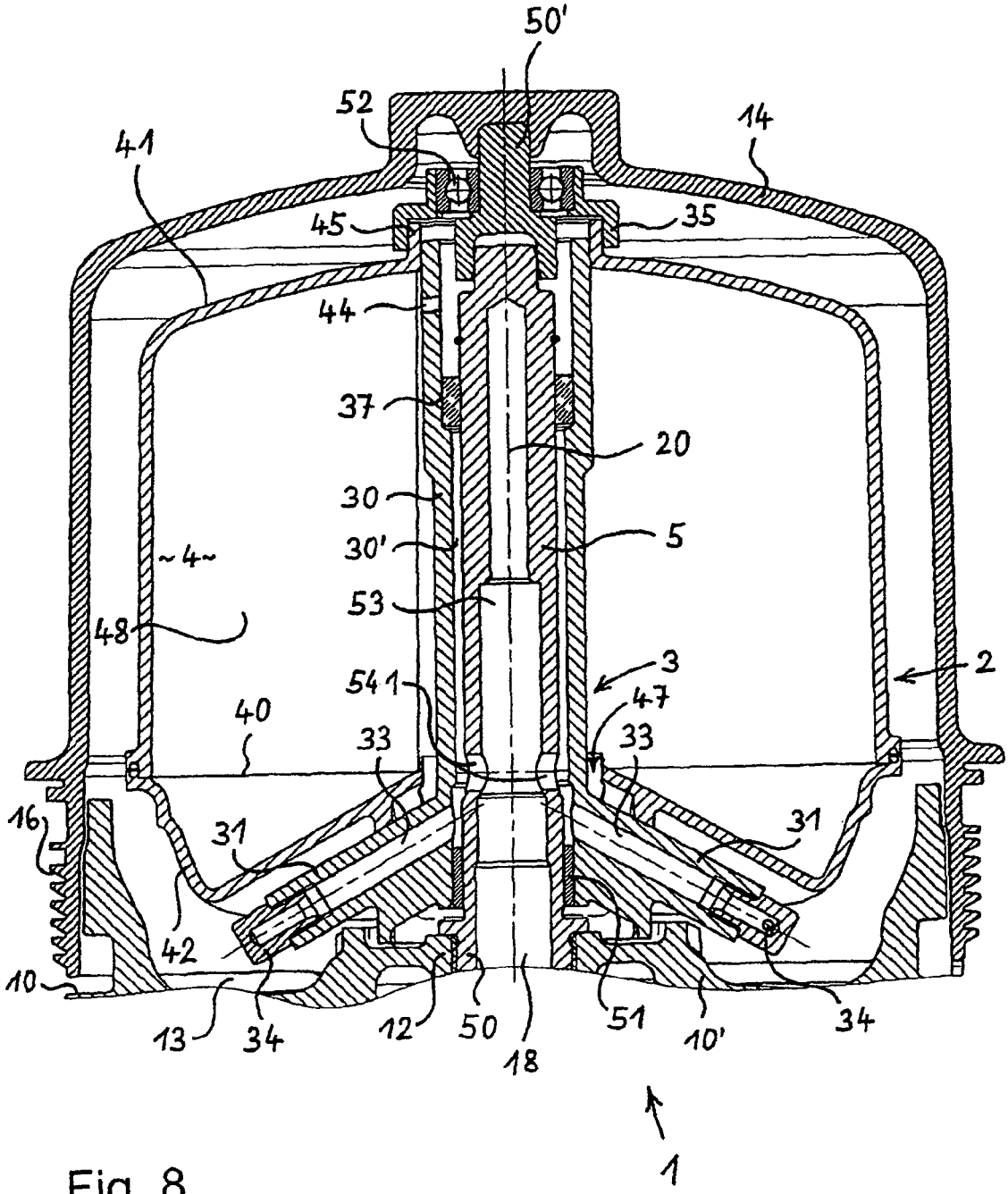
FIG. 8 shows a centrifuge with the rotor in another embodiment in longitudinal section.

FIG. 8 shows one example for a centrifuge 1 in longitudinal section in which the rotor 2 is combined of a bearing and drive part 3 and a waste collecting part 4 connected therewith.

Here again, the centrifuge 1 comprises a housing 10 which is closed on the upper side with a screw cover 14. In this respect, the screw cover 14 has an external thread 16 which fits into an internal thread of the housing 10 here not shown.

The rotor 2 is rotatable on bearings on the axis 5 in the interior of the housing 10, here essentially within the cover 14. With a bottom threaded end 50, the axis 5 is screwed into an axis reception 12 which is centrally provided in a housing part 10'. With its upper end 50', the axis 5 engages centrically into a matching cavity on the inside of the cover 14.

By means of two bearings 51 and 52, the bearing and drive part 3 is provided on the axis 5 and here comprises a tubular body 30 from whose bottom end two nozzle arms 31 extend diametrically opposed to each other radially outwardly. One oil channel 33 runs through each nozzle arm 31, the channel ending at the radially exterior end of each nozzle arm 31 in one recoil nozzle 34 each.

In this exemplary embodiment as well, the waste collecting part 4 is combined of two parts, of a top part 41 and of a bottom part 42 which are tightly connected with each other along a weld seam 40. As indicated in the left half of FIG. 8, the interior of the waste collecting part 4 can be provided with guide and stiffener walls 48 spaced apart from each other in circumferential direction and extending in radial direction which are here designed of one piece with the outer circumferential wall of the top part 41 and which freely end radially inside in the proximity of the outer circumference of the tubular body 30.

In its central upper area, the top part 41 has an axially upwardly extending collar which forms an annular area 45. This annular area 45 of the waste collecting part 4 is enclosed radially outside by an annular area 35 of the bearing and drive part 3. The annular area 35 is here designed as a separate crest in annular form which is provided on the upper end of the axis 50' with the intermediate layer of an upper rolling bearing 52. The annular area 45 of the inherently less stable, plastic waste collecting part 4 is centered by the dimensionally stable annular area 35, and this centering will even be improved during a rotation of the rotor 2 due to the resulting centrifugal forces acting upon the annular area 45.

During operation of the centrifuge 1 according to FIG. 8, lubricating oil flows through an inlet 18 located on the bottom into a central channel 53 which penetrates the axis 5 in its longitudinal direction and extends concentrically to the rotation axis 20 of the rotor 2. In the lower area of the channel 53, two radial openings 54.1 extend from it outwardly through the axis 5 and end in a ring channel 30' located between the outer circumference of the axis 5 and the inner circumference of the tubular body 30. A first partial lubricating oil flow flows into the two nozzle arms and their oil channels 33 and exits through the nozzles 34. The rotor 2 is thereby made to rotate according to the recoil principle around the rotation axis 20.

A second partial lubricating oil flow flows upwardly through the ring channel 30' and reaches the interior of the waste collecting part 4 close to its upper end—via a throttle point 37 and through at least one inlet 44. This second partial lubricating oil flow essentially flows through the waste collecting part 4 from top to bottom and then exits from the waste collecting part 4 through an outlet 47 located on the bottom and radially inside. The waste particles supplied to the lubricating oil collect in the waste collecting part 4 radially outside due to the resulting centrifugal forces and are thus separated from the lubricating oil.

The lubricating oil exiting from the waste collecting part 4 through the outlet 47 and the lubricating oil exiting from the nozzles 34 combine below the rotor 2 in a pressureless area 13 of the centrifuge 1 and drain off from there, for example into the oil sump of an associated internal combustion engine.

When the cover 14 is unscrewed, the upper end of the axis 50 can be removed upwardly in axial direction together with the rolling bearing 52 provided on the top and the crest seated outside on the bearing 52 and forming the annular area 35. Simultaneously therewith or thereafter, the waste collecting part 4 can also be separated by the upwardly axial removal from the bearing and drive part 3, and it can be replaced by a fresh waste collecting part 4. The centrifuge 1 is ready to operate again after positioning the upper end of the axis 50' with the bearing 52 and the annular area 35 and after screwing on the cover 14.

Figure 9:
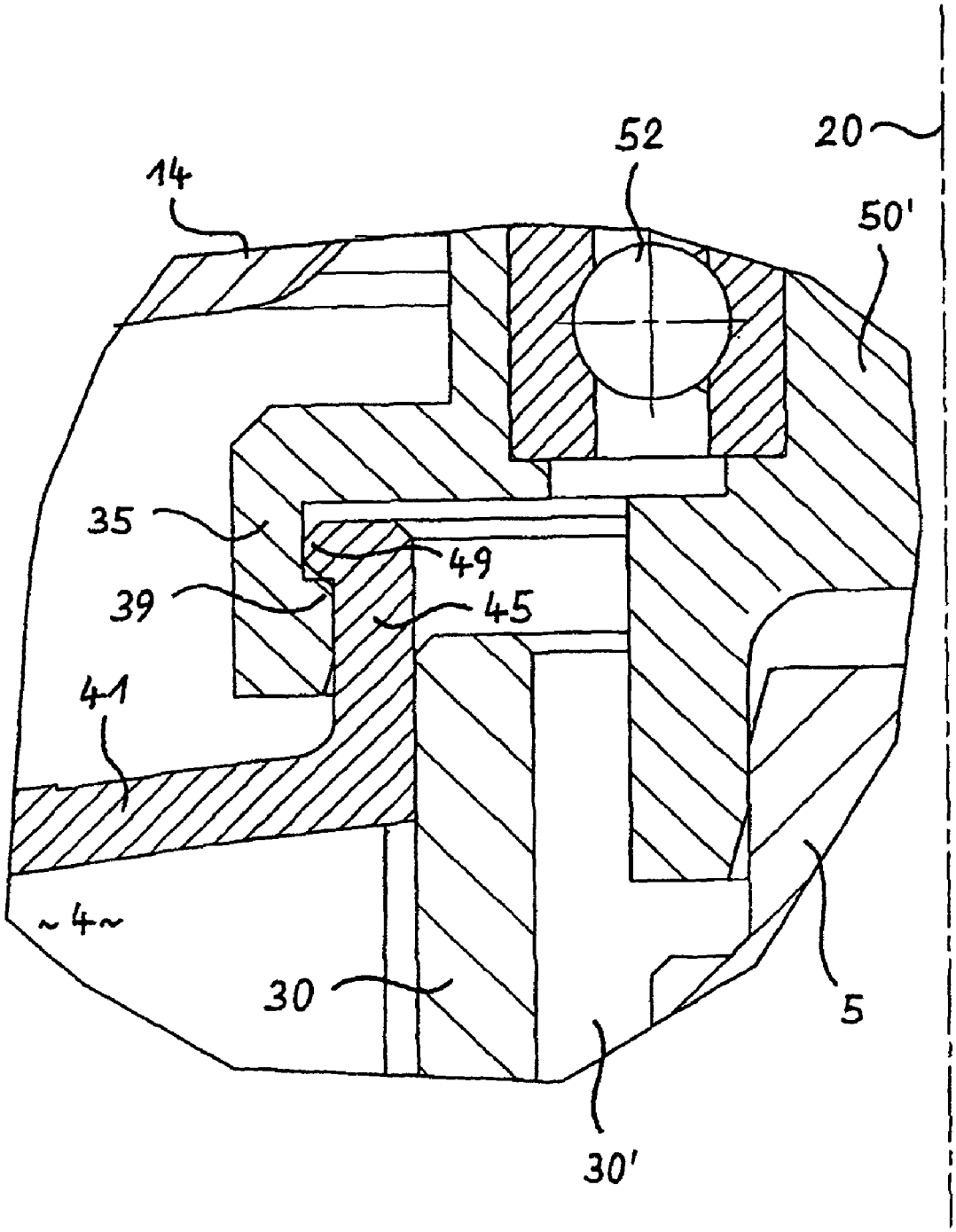
FIG. 9 shows a section from the upper area of the rotor of FIG. 8 in an enlarged sectional view.

FIG. 9 shows an enlarged section of the upper area of FIG. 8. The rotation axis 20 of the rotor is indicated on the right side in FIG. 9. The left thereof shows one part of the axis 5 and the upper end of the axis 50' positioned thereon. The bearing 52 is seated on the upper end of the axis 50', and in turn, the crest with the annular area 35 is provided radially outside on this bearing.

The lower part of FIG. 9 shows the upper end area of the tubular body 30 which protrudes, with its upper end, into the annular area 45 of the top part 41 of the waste collecting part 4. The ring channel 31' is located radially inside of the tubular body 30. The annular area 45 of the top part 41 projects radially inside into the annular area 35 and is centered by the latter.

Supplementary to the embodiment according to FIG. 8, the embodiment in FIG. 9 also provides that the annular areas 35 and 45 are equipped with interacting latching means 39 and 49. These latching means engage with each other when the upper end of the axis 50' with the bearing 52 and the annular area 35 are positioned in axial direction from top to bottom onto the top part 41 and its annular area 45. Seen in axial direction, the latching means 39 here grip behind the latching means 49. When the upper end of the axis 50 with the bearing 52 and the annular area 35 is upwardly removed in axial direction during maintenance of the centrifuge, the waste collecting part 4 is simultaneously taken along upwardly because axial tension forces can be transmitted via the latching means 39 and 49.

At the same time, the annular areas 35 and 45 here also serve to center the waste collecting part 4 upon rotation of the rotor during the operation of the centrifuge.

In the above described exemplary embodiments of the rotor 2, the form-fitting interacting circumference is used for centering the waste collecting part 4 and is formed by annular areas on the bearing part 3 and the waste collecting part 4. In the following described examples, the form-fitting circumference on bearing part 3 and waste collecting part 4 is formed by axial projections on the one hand and correspondingly arranged openings on the other hand, with different embodiments and arrangements being possible.

Figure 10:
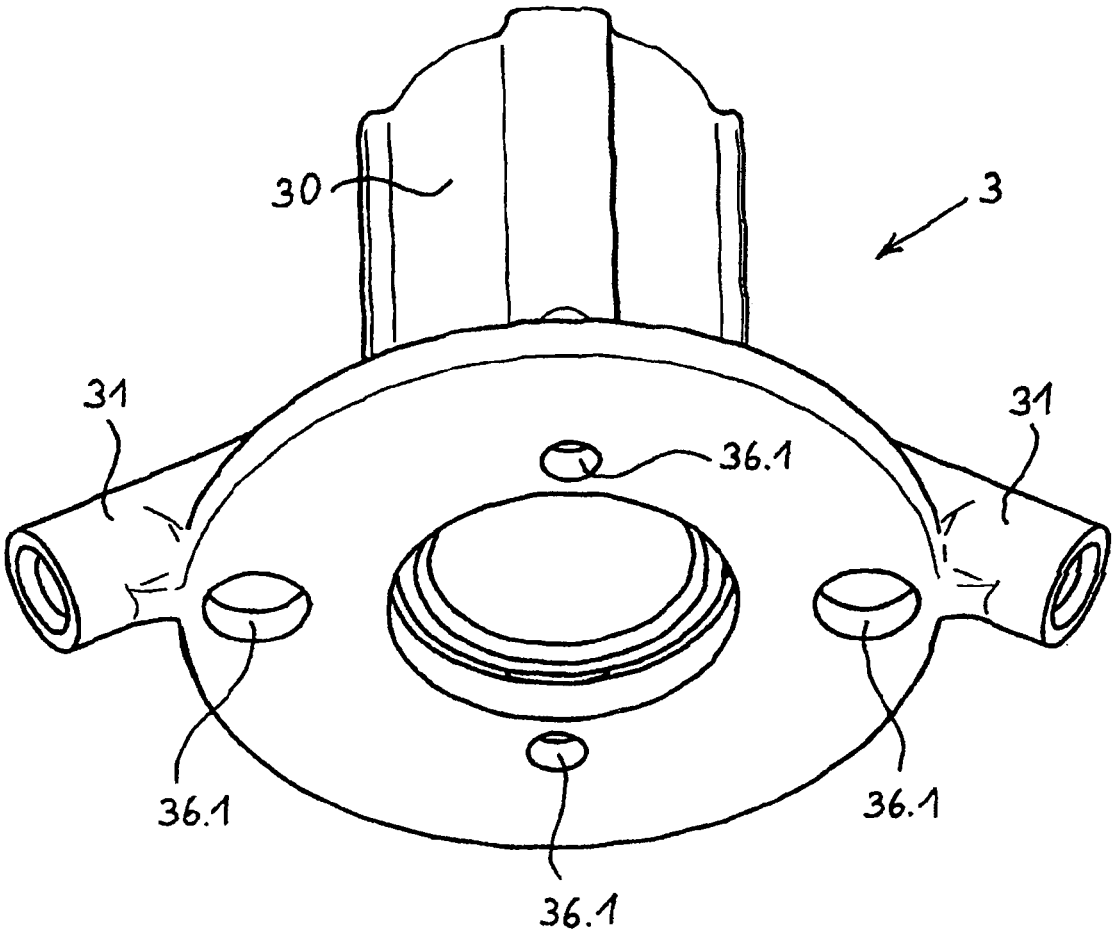
FIG. 10 shows the lower area of the bearing part of the rotor in a modified embodiment in a view diagonally from the bottom.

With the example shown in FIG. 10, a total of four circular openings or borings 36.1 are provided in the lower area on the bearing part 3 and can have different diameters among each other, as FIG. 10 exemplarily shows, and which can also be on different radii relative to the center axis of the bearing part 3. The openings 36.1 are here provided in a lower area of bearing part 3, the area having the form of a circular ring disk. One part of the tubular body 30 is still visible in the top of FIG. 10; the nozzle arms 31 are provided on the left and right in FIG. 10 and are not yet equipped with the associated nozzles.

Figure 11:
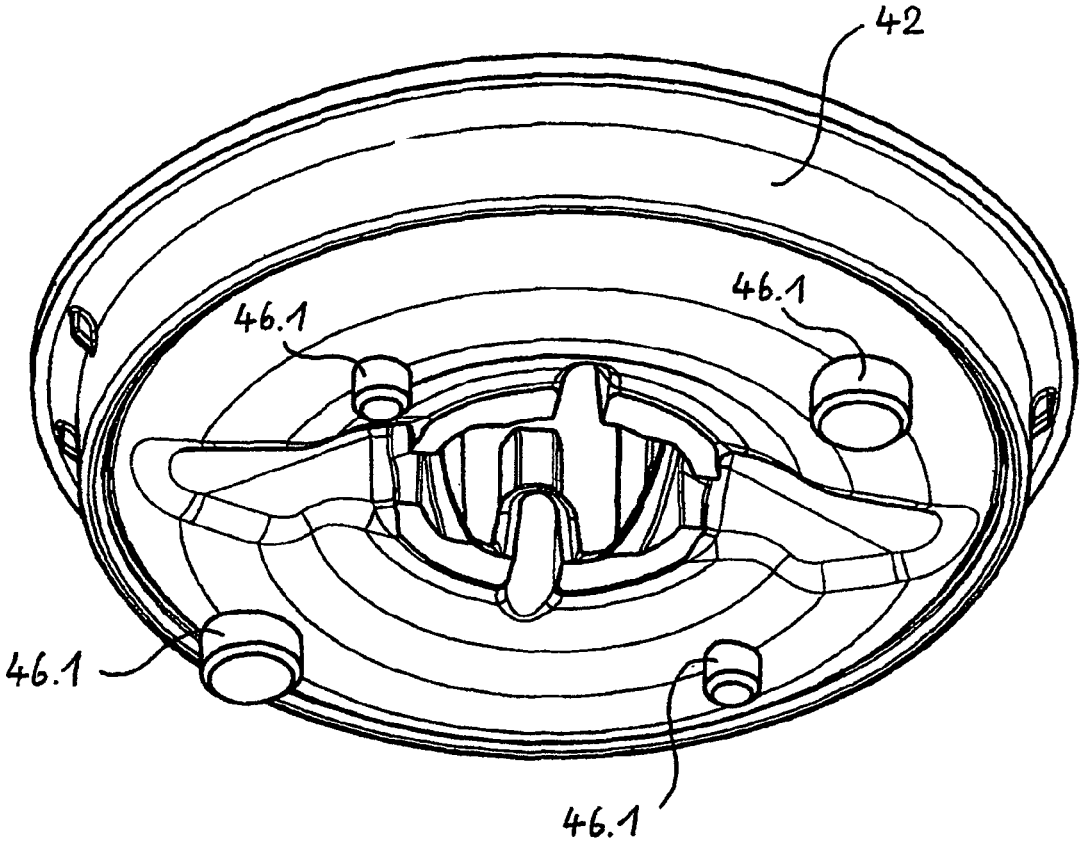
FIG. 11 shows the bottom part of the waste collecting part in an embodiment fitting to the bearing part according to FIG. 10, in a view diagonally from the bottom.

In a view diagonally from below, FIG. 11 shows the bottom part 42 of the otherwise not shown waste collecting part which fits with the bearing part 3 according to FIG. 10. On the underside of the bottom part 42 according to FIG. 11, a total of four projections 46.1 are molded on in the form of cylindrical pins and downwardly protruding in axial direction, preferably in one piece with the remaining bottom part 42. The position and the dimensions of the projections 46.1 are selected such that they match the openings 36.1 in the bearing part 3 according to FIG. 10. Initially, an adequate, small movement clearance is expediently provided in the basic condition; upon rotation of the rotor, the projections 46.1 rest in radial direction outwardly on the openings 36.1 under the effect of the centrifugal force and are thus fixed in their position so that undesirable deformations of the bottom part 42 and thus of the entire waste collecting part will be prevented.

Figure 12:
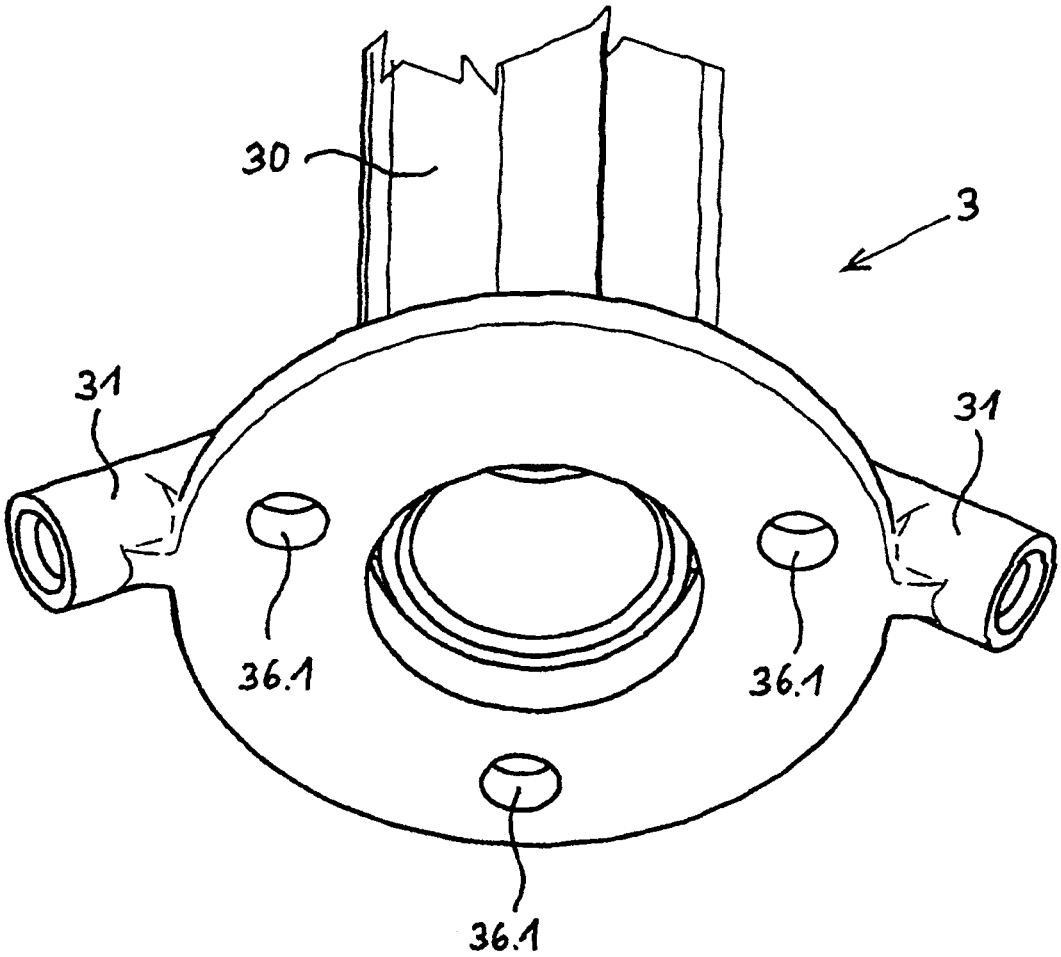
FIG. 12 shows the bottom area of the bearing part of the rotor in another embodiment, in a view diagonally from the bottom.

In the same manner of presentation as in FIG. 10, FIG. 12 shows a modified embodiment of the bearing part 3. The modification comprises that, in the embodiment according to FIG. 12, three circular openings 36.1 identical among each other are now provided in the lower part of the bearing part 3. All openings 36.1 are here provided on a uniform radius and in circumferential direction at a uniform distance from each other.

Figure 13:
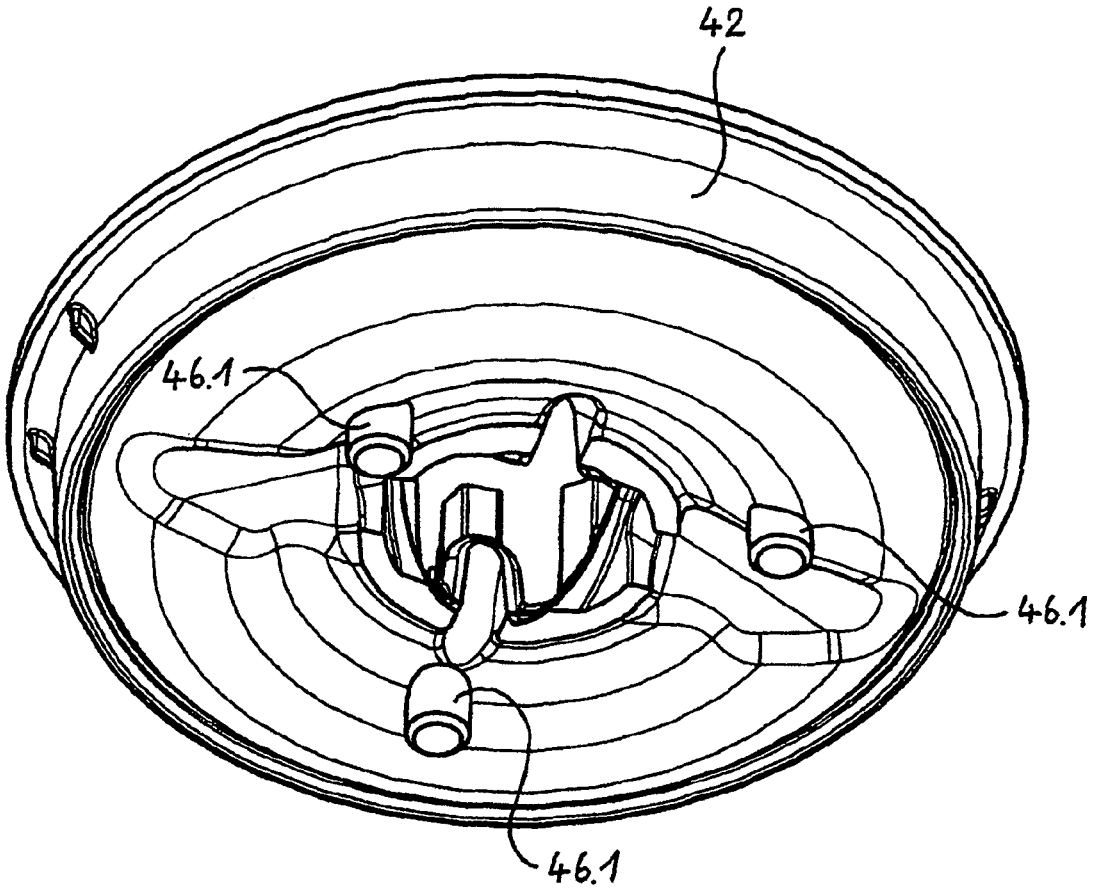
FIG. 13 shows the bottom part of the waste collecting part in an embodiment fitting to the bearing part according to FIG. 12, in a view diagonally from the bottom.

FIG. 13 shows the bottom part 42 of the waste collecting part matching the bearing part 3 according to FIG. 12. Three projections 46.1, congruent with the openings 36.1, in the form of cylindrical pins are downwardly protruding in axial direction and integrally molded on in one piece on the underside of the bottom part 42.

Figure 14:
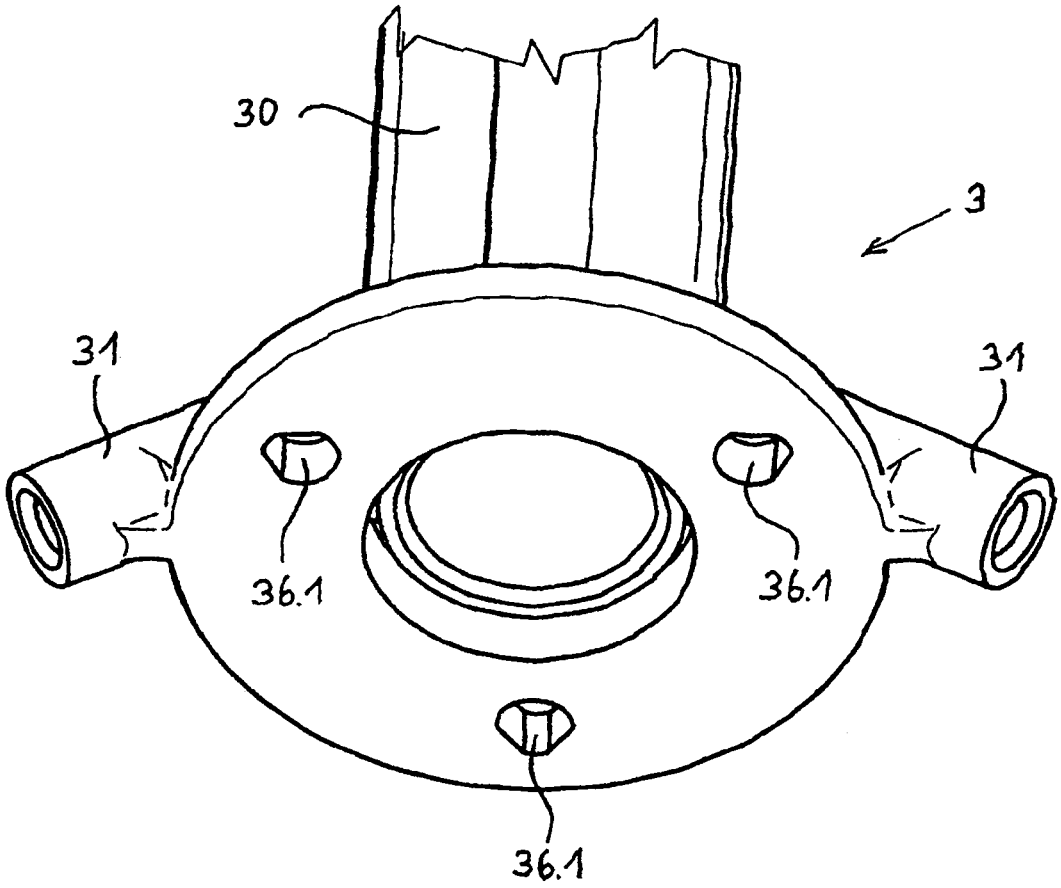
FIG. 14 shows the bottom area of the bearing part of the rotor in an embodiment slightly modified versus the embodiment according to FIG. 12, in a view diagonally from the bottom.

FIG. 14 shows the bearing part 3 in a slightly modified form versus FIG. 12. The modification consist in the openings 36.1 with the bearing part 3 according to FIG. 14 not being circular but having outwardly converging bevels in radial direction whereby a centering effect is applied, in connection with the centrifugal force, on the projections 46.1 engaging in the openings 36.1 (compare FIG. 13).

With the embodiments according to the FIGS. 10 to 14, the openings 36.1 are each provided on the side of the bearing part 3 and the corresponding projections 46.1 on the side of the waste collecting part 4. A reverse arrangement thereto is shown as an embodiment in the FIGS. 15 and 16.

Figure 15:
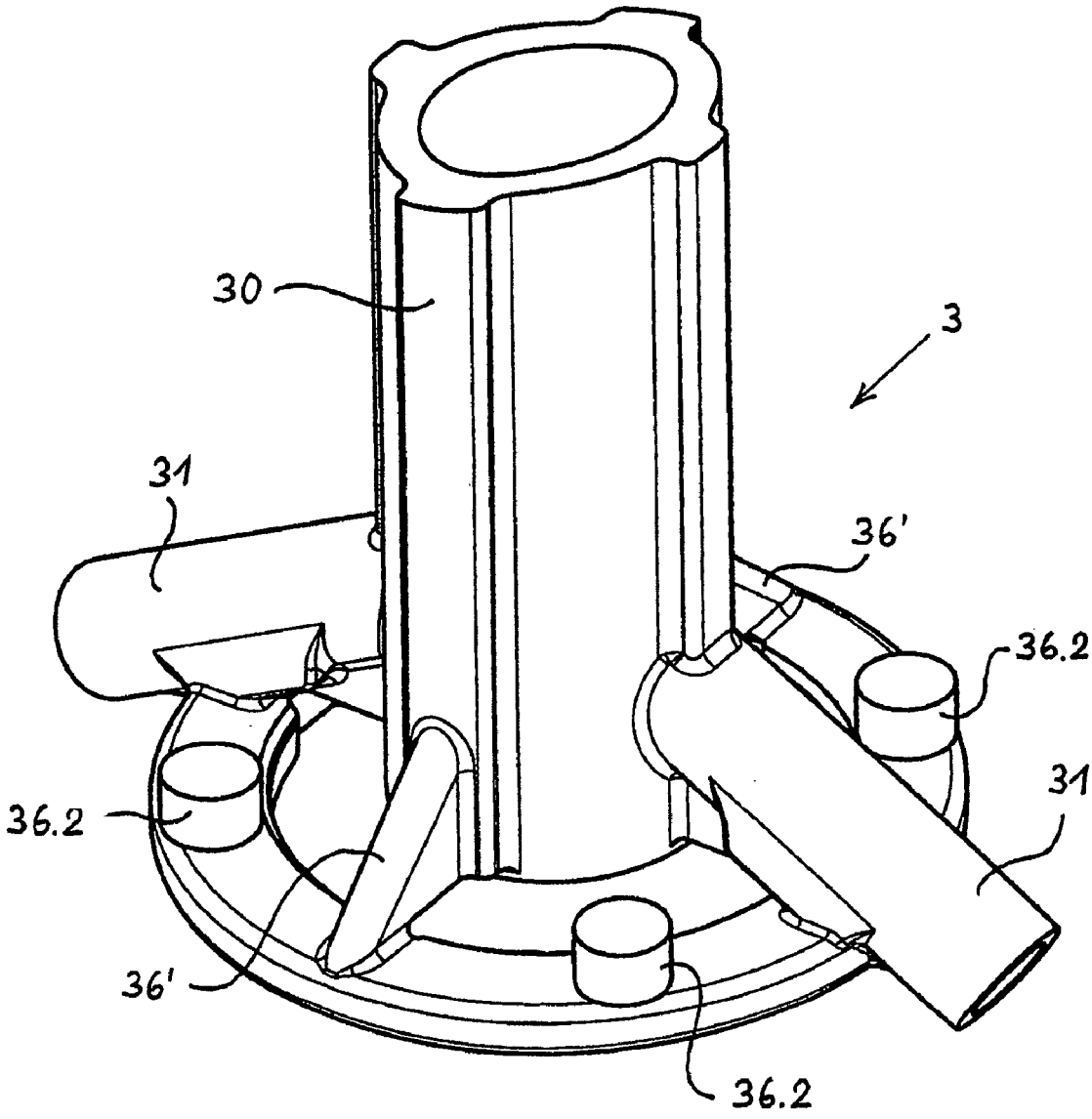
FIG. 15 shows the bearing part of the rotor in another embodiment, in a view diagonally from the top.

With the bearing part 3 visible in FIG. 15 in a view diagonally from the top, its tubular body 30 is on top from which the two nozzle arms 31 extend outwardly in radial direction which are here also not yet equipped with their appropriate nozzles. Here again, the lower area of the bearing part 3 forms a section in the form of a circular ring disk which is designed in one piece with the remaining bearing part 3. This section is connected with the tubular body 30 in one piece not only via the nozzle arms 31 but also via two carrying arms 36' arranged between them. On the section of the bearing part 3 having the form of the circular ring disk, a total of four projections 36.2 in the form of cylindrical pins are arranged projecting upwardly, with one of these projections 36.2 here lying behind the tubular body 30 and therefore not being visible. The projections 36.2 of the bearing part 3 are arranged on a uniform radius and are equidistant from each other in circumferential direction, here 90° each. Moreover, the projections 36.2 among each other are identical in diameter and height.

Figure 16:
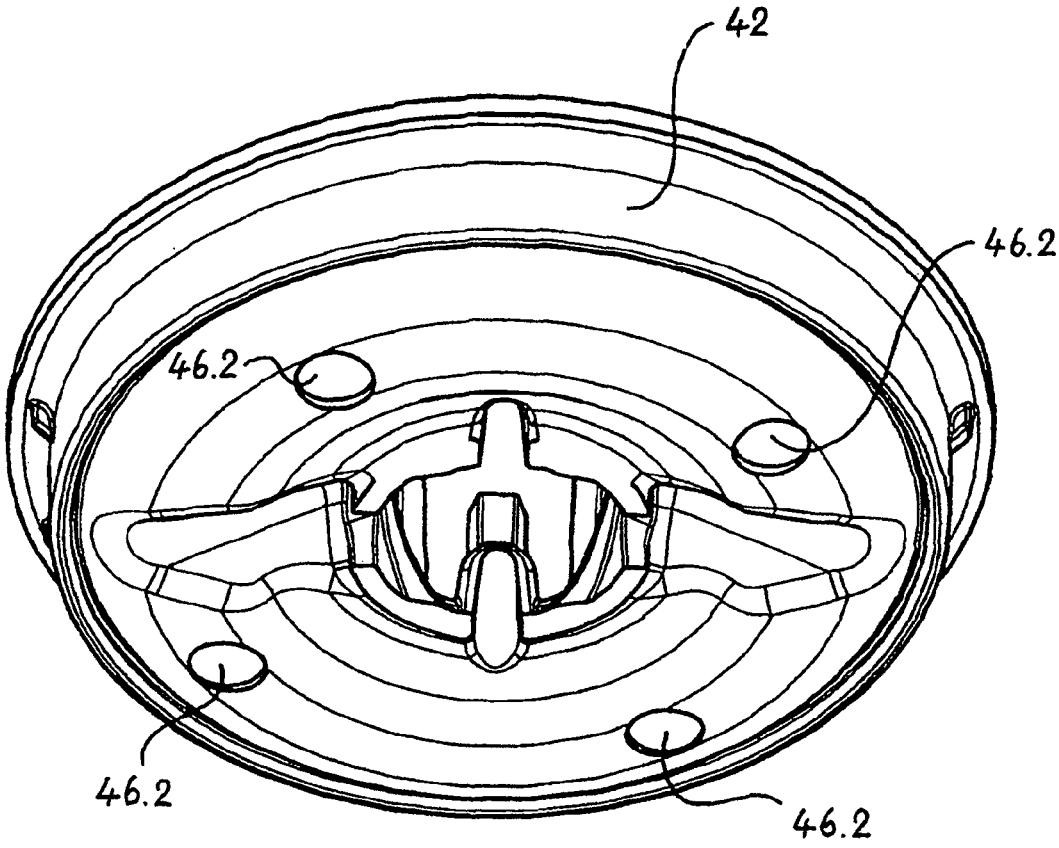
FIG. 16 shows the bottom part of the waste collecting part in an embodiment fitting to the bearing part according to FIG. 15, in a view diagonally from the bottom.

FIG. 16 shows a matching bottom part 42 of a waste collecting part in a view diagonally from the bottom. According to the arrangement and the diameter of the projections 36.2 of the bearing part 3 in FIG. 15, four openings 46.2 are provided in the bottom part according to FIG. 16.

In all exemplary embodiments according to the FIGS. 10 to 16, the projections 46.2 or, respectively, 36.2 of the bottom part 42 or the bearing part 3 respectively are connected by axial positioning with the openings 36.1 or, respectively, 46.1 on the bearing part 3 or the bottom part 42, respectively. In its connected condition, upon the influence of centrifugal force and/or heat, the circumference 46.1 or 46.2 provided on the bottom part 42 of the waste collecting part rests on the correspondingly provided, positionally stable circumference 36.1 or 36.2 on the bearing part 3, whereby the bottom part 42 and thus the waste collecting part 4 is centered, irrespective of the corresponding design, in its form as well as in relation to the bearing part 3.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A rotor for a centrifuge, wherein the rotor is rotatably driven about a rotation axis has an outer circumference spaced a radial distance from the rotation axis and comprises two parts, a central bearing part and a waste collecting part which is provided with a waste collecting area, comprising:

the waste collecting part being separable from the bearing part for one of waste disposal and cleaning;

the bearing part and the waste collecting part being provided with torque transmitting surfaces which interact with each other in at least one of a form-fitting and adherence manner, and being connectable by axially positioning the waste collecting part on the bearing part and disconnectable by axially removing the waste collecting part from the bearing part;

circumferences of the bearing part and the waste collecting part being connectable in a form-fitting manner and arranged in such a way that the waste collecting part circumference engages with the corresponding circumference of the bearing part one of in the initial state of the waste collecting part and as a result of the radial expansion thereof produced by at least one of a centrifugal force and by heating;

the form-fitting circumferences being formed by annular areas;

the bearing part being made of one of metal and plastic and comprising an annular area on at least one of an axially top and an axially bottom, concentric to the rotation axis;

the waste collecting part being made of plastic and comprising an annular area on at least one of an axially top and an axially bottom;

in a combined condition of the bearing part and the waste collecting part, the annular area of the bearing part surrounding an outside of the annular area of the waste collecting part; and the form-fitting circumferences, seen in radial direction, being arranged at a distance of no more than one half of the radial distance of the outer circumference of the rotor from the rotation axis.

2. A rotor according to claim 1, wherein the annular area of the bearing part is formed with a circumference that is one of continuous in extent and a sequence of at least two sections together forming an annular shape.

3. A rotor according to claim 1, wherein the annular area of the waste collecting part is formed with a circumference that is one of continuous in extent and a sequence of at least two sections together forming an annular shape.

4. A rotor according to claim 1, wherein each annular area of the waste collecting part comprises, upon a standstill of the rotor, an initial dimension d of its outer diameter which is no larger than an inner diameter D of the annular area of the bearing part, and upon the rotation of the rotor during operation of the centrifuge each annular area of the waste collecting part in its outer diameter is expandable by an effect of centrifugal force against the diameter D.

5. A rotor according to claim 1, wherein each annular area of the waste collecting part comprises, upon a standstill of the rotor, an initial dimension d of its outer diameter which is larger than the inner diameter D of the annular area of the bearing part, and after axial positioning of the waste collecting part on the bearing part, their annular areas are in connection with each other under pretension.

6. A rotor according to claim 1, wherein the bearing part on top has a tubular, upwardly open end section as the annular area and the waste collecting part on top has a central, axially inwardly extending collar as the annular area which engages in the bearing part end section.

7. A rotor according to claim 6, wherein the end section forming the annular area and the collar forming the annular area are equipped with an interacting latch forming a disengageable latching connection for the removal of the waste collecting part.

8. A rotor according to claim 7, wherein the collar forming the annular area comprises two operating arms protruding upwardly over the waste collecting part to permit manual disengagement of the latching connection.

9. A rotor according to claim 1, wherein the bearing part on top comprises an annular, downwardly open crest as the annular area and the waste collecting part on top comprises a central, axially outwardly extending collar area as the annular area which engages into the crest.

10. A rotor according to claim 1, wherein the waste collecting part is formed on the bottom in one piece with a central, axially outwardly extending collar as the annular area.

11. A rotor according to claim 1, wherein the bearing part comprises a driving mechanism arranged to drive the rotor.

12. A rotor according to claim 11, wherein the bearing part comprises a central tubular body forming a lubricating oil channel and two nozzle arms extending radially outwardly from the tubular body, each arm having one oil channel leading to a recoil nozzle with the form-fitting circumference of the bearing part being formed or provided at least partly on the nozzle arms.

13. A rotor according to claim 12, wherein the form-fitting circumference of the bearing part additionally rests on a plurality of carrying arms extending radially outwardly from the tubular body.

14. A rotor according to claim 13, wherein the tubular body with the nozzle arms and the carrying arms is one of a one-piece die cast part or injection molded part.

15. A rotor for a centrifuge, wherein said rotor is rotatably driven about a rotation axis and comprises two parts, a central bearing part and a waste collecting part which is provided with a waste collecting area, the waste collecting part is separable from the bearing part for waste disposal or cleaning, the bearing part and the waste collecting part are provided with torque transmitting surfaces which interact with each other in at least one of a form-fitting and adherence manner and are connectable by axially positioning the waste collecting part on the bearing part and disconnectable by axially removing the waste collecting part from the bearing part; the circumferences of the bearing part and the waste collecting part are connectable in a form-fitting manner and arranged in such a way that the waste collecting part circumference engages with the corresponding circumference of the bearing part one of at the initial state of the waste collecting part, and as a result of the radial expansion thereof produced by at least one of a centrifugal force and by heating; and the form-fitting circumferences are formed by a plurality of axial projections on one of the waste collecting part and the bearing part and a plurality of corresponding recesses on the other of the waste collecting part and the bearing part.

16. A rotor according to claim 15, wherein the axial projections are formed by pins and the corresponding recesses by borings.

17. A rotor according to claim 15, wherein the rotor has an outer circumference spaced a radial distance from the rotation axis and the form-fitting circumferences, seen in radial direction, are arranged at a distance of no more than one half of the radial distance of the outer circumference of the rotor from the rotation axis.

18. A rotor according to claim 15, wherein the rotor has an outer circumference spaced a radial distance from the rotation axis and the form-fitting circumferences, seen in radial direction, are arranged at a distance of no more than one third of the radial distance of the outer circumference of the rotor from the rotation axis.

19. A rotor according to claim 15, wherein the waste collecting part comprises a driving mechanism arranged to drive the rotor.

20. A rotor according to claim 19, wherein the bearing part comprises a central tubular body with two radially outwardly extending openings and the waste collecting part comprises two sealing oil channels connected with the openings and each leading to a recoil nozzle as forming the drive mechanism.

21. A rotor according to claim 15, wherein the waste collecting part comprises two one-piece injection molded parts which are tightly connected with each other in a plane perpendicular to the rotation axis of the motor.

22. A rotor according to claim 21, wherein the two injection molded parts of the waste collecting part are welded to each other.

23. A centrifuge comprising:

a rotor rotatably driven about a rotation axis having an outer circumference spaced a radial distance from the rotation axis and comprising two parts, a central bearing part and a waste collecting part provided with a waste collecting area, the waste collecting part being separable from the bearing part for waste disposal or cleaning, the bearing part and the waste collecting part being provided with torque transmitting surfaces which interact with each other in at least one of a form-fitting and adherence manner and being connectable by axially positioning the waste collecting part on the bearing part and disconnectable by axially removing the waste collecting part from the bearing part;

circumferences of the bearing part and the waste collecting part being connectable in a form-fitting manner and arranged in such a way that the waste collecting part circumference engages with the corresponding circumference of the bearing part one of at the initial state of the waste collecting part, and as a result of the radial expansion thereof produced by at least one of a centrifugal force and by heating;

the form-fitting circumferences being formed by annular areas;

the bearing part being made of one of metal and plastic and comprising an annular area on at least one of an axially top and an axially bottom, concentric to the rotation axis;

the waste collecting part being made of plastic and comprising an annular area on at least one of an axially top and an axially bottom;

in a combined condition of the bearing part and the waste collecting part, the annular area of the bearing part surrounding an outside of the annular area of the waste collecting part; and the form-fitting circumferences, seen in radial direction, being arranged at a distance of no more than one half of the radial distance of the outer circumference of the rotor from the rotation axis.

24. A centrifuge according to claim 23, wherein it is a centrifuge for cleaning lubricating oil of an internal combustion engine.

25. A centrifuge comprising:

a rotor rotatably driven about a rotation axis and comprising two parts, a central bearing part and a waste collecting part provided with a waste collecting area, the waste collecting part being separable from the bearing part for waste disposal or cleaning, the bearing part and the waste collecting part being provided with torque transmitting surfaces which interact with each other in at least one of a form-fitting and adherence manner and being connectable by axially positioning the waste collecting part on the bearing part and disconnectable by axially removing the waste collecting part from the bearing part; the circumferences of the bearing part and the waste collecting part being connectable in a form-fitting manner and arranged in such a way that the waste collecting part circumference engages with the corresponding circumference of the bearing part one of at the initial state of the waste collecting part, and as a result of the radial expansion thereof produced by at least one of a centrifugal force and by heating; and the form-fitting circumferences being formed by a plurality of axial projections on one of the waste collecting part and the bearing part and a plurality of corresponding recesses on the other of the waste collecting part and the bearing part.

* * * * *

UNITED STATES PATENT AND TRADEMARK OFFICE

CERTIFICATE OF CORRECTION

PATENT NO. : 8,002,690 B2
APPLICATION NO. : 11/913485
DATED : August 23, 2011
INVENTOR(S) : Wiesmann et al.

It is certified that error appears in the above-identified patent and that said Letters Patent is hereby corrected as shown below:

On the Title Page:

After "(65) Prior Publication Data" and the publication listed, please insert -- (30) Foreign Application Priority Data
May 2, 2005 (DE) 20 2005 007 162.5 --

Signed and Sealed this
Third Day of January, 2012

David J. Kappos

David J. Kappos
*Director of the United States Patent and Trademark Office*